US009086683B2

(12) United States Patent
Funk et al.

(10) Patent No.: US 9,086,683 B2
(45) Date of Patent: Jul. 21, 2015

(54) SINGLE HAND TIMEPIECE

(71) Applicant: Biegert & Funk Product GmbH & Co KG, Schwaebisch Gmuend (DE)

(72) Inventors: Andreas Funk, Schwaebisch Gmuend (DE); Marco Biegert, Schwaebisch Gmuend (DE)

(73) Assignee: BIEGERT & FUNK PRODUCT GMBH & CO. KG (DE)

( * ) Notice: Subject to any disclaimer, the term of this patent is extended or adjusted under 35 U.S.C. 154(b) by 0 days.

(21) Appl. No.: 14/279,364

(22) Filed: May 16, 2014

(65) Prior Publication Data

US 2014/0340998 A1 Nov. 20, 2014

(30) Foreign Application Priority Data

May 17, 2013 (EP) ..... 13002618

(51) Int. Cl.

| | |
|---|---|
| ***G04B 19/04*** | (2006.01) |
| ***G04C 3/14*** | (2006.01) |
| ***G04C 17/00*** | (2006.01) |
| *G04B 19/24* | (2006.01) |

(52) U.S. Cl.

CPC ..... *G04B 19/04* (2013.01); *G04B 19/048* (2013.01); *G04C 3/14* (2013.01); *G04C 17/00* (2013.01); *G04B 19/24* (2013.01)

(58) Field of Classification Search

CPC ..... G04B 19/04; G04B 19/048; G04B 19/24; G04C 17/00; G04C 3/14

See application file for complete search history.

(56) References Cited

U.S. PATENT DOCUMENTS

| | | | | |
|---|---|---|---|---|
| 1,393,569 | A * | 10/1921 | Richardson | 368/233 |
| 1,851,824 | A * | 3/1932 | Fewell | 368/228 |
| 2,709,331 | A * | 5/1955 | Lehner | 368/254 |
| 3,911,668 | A * | 10/1975 | Beguin | 368/80 |
| 5,103,434 | A * | 4/1992 | Sullivan | 368/238 |
| 5,134,596 | A * | 7/1992 | Harris | 368/80 |
| 5,172,350 | A * | 12/1992 | Walen et al. | 368/238 |
| 5,280,461 | A * | 1/1994 | Belik | 368/228 |
| 5,303,211 | A * | 4/1994 | Yanaka et al. | 368/76 |
| 6,359,840 | B1 | 3/2002 | Evans | |
| 2002/0163858 | A1 * | 11/2002 | Greenwood | 368/28 |
| 2005/0207281 | A1 * | 9/2005 | Geyer | 368/15 |
| 2011/0299365 | A1 | 12/2011 | De Biase | |
| 2013/0003504 | A1 * | 1/2013 | Caruso | 368/21 |
| 2013/0039156 | A1 * | 2/2013 | Lin | 368/228 |

FOREIGN PATENT DOCUMENTS

| | | |
|---|---|---|
| DE | 4003655 | 4/1991 |
| DE | 29912624 | 11/1999 |

(Continued)

*Primary Examiner* — Amy Cohen Johnson
*Assistant Examiner* — Matthew Powell
(74) *Attorney, Agent, or Firm* — Stuart H. Mayer; Mayer & Williams PC

(57) ABSTRACT

The invention concerns a timepiece that has a single hand, which is movable into a plurality of hand positions. The timepiece has a clockwork for mechanically moving the hand so that the hand is located in a hand position which corresponds to a current time of day and an actuating element connected to the clockwork. The clockwork is designed to change, upon actuation of the actuating element, from a first operating state into a second operating state and to move the hand so that the hand position in the first operating state displays minute information and in the second operating state displays hour information.

13 Claims, 1 Drawing Sheet

(56) References Cited

FOREIGN PATENT DOCUMENTS

| | | |
|---|---|---|
| DE | 202008010962 | 10/2008 |
| FR | 1422624 | 12/1965 |
| GB | 185321 | 9/1922 |
| WO | 01/71433 A1 | 9/2001 |

* cited by examiner

SINGLE HAND TIMEPIECE

BACKGROUND OF THE INVENTION

The invention relates to a single hand timepiece having a clockwork and a single hand. In contrast to conventional timepieces that display the time of day with an hour hand and a minute hand, single hand timepieces use only a single hand for this purpose. Whereas originally the motivation to use a single hand may have been the possible simplification of a mechanical clockwork, in the present day an advantage of timepieces with only a single hand can be found especially in the particular design of the timepiece. Thus, the use of a single hand allows space for a design reduced to the essentials.

Known single hand timepieces generally have a single hand, the movement of which corresponds to a conventional hour hand. Different auxiliary means have been proposed in order to allow the most accurate possible reading of the time of day.

For example, the document U.S. Pat. No. 5,280,461 A shows a timepiece with an hour hand in which a slide is mounted that is movable in the longitudinal direction of the hour hand. Minute information should be readable from the position of the slide.

From the document U.S. Pat. No. 5,134,596 A, a single hand timepiece is known the face of which has two scales. Hour information can be read at an inner scale, and minute information can be read at an outer scale. Here, the outer scale has a graduation into five minute intervals.

From the document FR 1 422 624 A, a single hand timepiece is known whose face, in addition to an hour scale, has step-shaped lines which allow reading of minute information in 15 minute intervals.

From the document GB 185 321 A, a single hand timepiece is known the face of which has particularly fine scale graduations in minute steps. A special balancing mechanism should additionally guarantee the correct position of the tip of the hand.

Other known single hand timepieces have a single hand which rotates once in 24 hours so that day and night can be differentiated. The slower movement of the hand, compared to hand rotating in 12 hours, also makes exact reading more difficult.

Timepieces that have clockworks working separately from each other are also known, wherein one of the clockworks drives an hour hand and one a second clockwork drives a minute hand. Such timepieces are known for example from the documents DE 299 126 24 U1 and DE 20 2008 010 962 U1.

A wristwatch with a minute hand is known from the document DE 40 03 655 C1. An image disk rotates below the minute hand, wherein the appearance of the minute hand is influenced by the position of the image disk. This should allow reading of hour information at the minute hand.

A timepiece with a minute hand and an hour hand is known from the document US 2011/0299365 A1. The two hands display the time of day in the conventional manner. By pressing a button, the minute hand can be brought into a different position in which it displays the day of the current date on a special scale from 1 to 31.

SUMMARY OF THE INVENTION

Starting from this background, the object of the invention is to provide a single hand timepiece which is easy to build, allows a particularly sleek and elegant design and yet can be read accurately to the minute.

This object is solved by the single hand timepiece with the characteristics of claim 1. Advantageous designs are specified in the subsequent dependent claims.

The single hand timepiece has a single hand, which is movable into a plurality of hand positions, a clockwork for mechanically moving the hand so that the hand is located in a hand position which corresponds to a current time of day, characterized in that the single hand timepiece has an actuating element connected to the clockwork, and the clockwork is designed to change, upon actuation of the actuating element, from a first operating state into a second operating state, and to move the hand so that the hand position in the first operating state displays minute information and in the second operating state displays hour information.

The single hand can have an elongated basic shape. It can be mounted, in a rotatable manner, at one end or at a center section and for this purpose can be rigidly connected to an axis of rotation that is mounted, in a rotatable manner, in a case of the single hand timepiece. An end of the hand remote from the axis of rotation can have a tip of the hand. The position of this end of the hand relative to the axis of rotation, or respectively relative to a face of the single hand timepiece, allows reading of the minute information, or respectively hour information. For this purpose, the face can have an optional scaling, for example in the form of markings in five minute intervals, thus at the positions of the hour markings of a conventional face with an hour graduation. Additional markings on the face can specify the positions in minute intervals. The face in addition, or alternatively, to the markings can have numbers, for example from 1 to 12.

The hand can be moved mechanically by the clockwork into a plurality of hand positions, wherein in the case of a hand mounted in a rotatable manner, the tip of the hand can rotate around a circular path. In order for the position of the hand to always correspond to the current time of day, the clockwork has information about the current time of day. The clockwork can have a pulse generator for this purpose, for example a quartz crystal, a balance wheel or a tourbillon.

In the invention, the single hand timepiece has an actuating element that can be actuated by a user of the timepiece. The actuating element can be, in particular a button, a key, a sensor surface or a sensor field. Accordingly, the actuating element can be actuated simply by contacting or pressing for instance, using a finger for example.

The clockwork has two operating states. In the first operating state, which can also be called the basic state, the clockwork moves the hand so that the hand position displays minute information. In the second operating state, into which the clockwork changes upon actuating the actuating element, the single hand displays hour information.

The invention is based upon the recognition that in the case of typical reading procedures of a timepiece, the hour information is of lesser interest because many users already have this information before reading a timepiece. Frequently, the minute information is more important, for example in order to keep an imminent appointment. Consequently, the inventors have realized that with a single hand timepiece, it is not necessary to always display the hour information. In this situation, for accurate and easy readability of the timepiece, it is a great practical advantage to display the minute information in a simple and precisely readable form using the single hand in the basic state, instead of aiming for an adequately exact readability with the simultaneous display of hour and minute information, using complicated auxiliary means, such as the initially depicted known single hand timepieces.

However, in many situations readability of the hour information is essential. This is considered in the invention by the second operating state in which the single hand displays the hour information.

Thus with the single hand timepiece according to the invention, in most situations a single glance at the hand position is sufficient in order to be informed about the current time of day. If in addition to this it is necessary to read the hour information, a single actuation of the actuating element and a second glance at the timepiece is sufficient.

A particular advantage of the invention exists in that both the minute as well as the hour information can be read particularly easily. In particular, both pieces of information can be represented in a manner known from conventional timepieces. A user does not need to become tediously accustomed to a specific display form of the single hand timepiece. At the same time, the single hand timepiece according to the invention can be easy to build. As with other single hand timepieces, this timepiece also requires only a single hand. In addition, the requirements on the precision of the hand movement do not differ from those of a conventional timepiece having a minute hand.

In one design, the clockwork is designed so that exactly 60 uniquely distinguishable hand positions are possible. These hand positions in the first operating state can correspond in particular to the minute divisions of a face of a conventional timepiece having a minute hand. In this design hand positions between these minute positions are not possible; moreover the hand jumps from one hand position to the next. This way, at any point in time, it can be recognized without a doubt which minute corresponds to the current hand position.

In one design, the clockwork is designed so that in the second operating state exactly twelve uniquely distinguishable hand positions are possible. These twelve hand positions can correspond in particular to the positions of an hour hand of a conventional timepiece, in each case to the full hour. In the second operating state, the clock work moves the hand so that the hand in each case takes on exactly one of the twelve hand positions. Intermediate positions are not possible. In the second operating state, the hand position thereby differs from the hand position of a conventional hour hand, which as a rule rotates stepplessly and also takes on intermediate positions between the positions thereof to two subsequent complete hours. This is advantageous for reading the hour information with absolute certainty.

In one design, the clockwork has an electromechanical control element for moving the hand. Basically the single hand timepiece can also be equipped with a mechanical clockwork that uses a spring, for example, as an energy store. Preferably however the single hand timepiece has an electromechanical control element, for example a stepping motor that moves the hand. The single hand timepiece can have a battery as an energy store. An electromechanical control element can be controlled in the desired manner particularly easily.

In one design, the clockwork is an electronic clockwork. Here, the electronic clockwork can be, in particular, a quartz crystal clockwork that uses an oscillating crystal as a time base. A radio controlled clockwork that has an antenna with which a broadcast time signal is received via radio, is also suitable. In these cases, the single hand timepiece can also have a battery as an energy store. The electronic clockwork can have a control which processes time information and a signal from the actuating element, and converts these into suitable control signals for an electromechanical control element for the hand.

In one design, the single hand timepiece has an armband. In this case, it is a single hand wristwatch. Basically, the single hand timepiece can also be designed as a standing or wall clock or other mobile timepiece, such as a pocket watch.

In one design, the clockwork is designed so that after actuation of the actuating element, the clockwork changes back automatically into the first operating state. For example, the second operating state, into which the control changes upon actuation of the actuating element, is maintained only for as long as the actuating element is actuated. Subsequently, thus after actuating the actuating element, the control can automatically change back into the first operating state so that the minute information is displayed again.

In one design, the control is designed so that it remains in the second operating state for a specified period after actuation of the actuating element. The specified period can be particularly in the range of one to ten seconds, preferably in the range of two to five seconds, particularly about three seconds. In this case, it is insignificant how long the actuating element is actuated. After each actuation, the control remains in the second operating state for a period that is sufficient for reliably reading the hour information. Then the control can automatically change back to displaying the minute information.

In one design the clockwork is designed so that upon actuating the actuating element twice, the clockwork changes into a third operating state and the hand is moved so that the hand position displays second information in the third operating state. In particular the change into the third operating state can occur if the actuating element is actuated twice within a specific time period. In particular actuating the actuating element twice can consist in that the second actuation occurs at a point in time in which the clockwork is still in the second operating state due to a first actuation of the actuating element. In this case, the clockwork changes into the third operating state. If there is no further actuation of the actuating element, the clockwork can automatically change back into the first operating state, particularly as explained for instance in conjunction with the automatic change from the second into the first operating state. The design allows simple and exact reading of second information without a further display element being required for this purpose.

In one design the clockwork is designed so that upon actuating the actuating element three times, the clockwork changes into a fourth operating state and the hand is moved so that the hand position displays day information in the fourth operating state. The day information relates to the day of the current date.

In one design the clockwork is designed so that upon actuating the actuating element four times, the clockwork changes into a fifth operating state and the hand is moved so that the hand position displays month information in the fifth operating state. The month information relates to the current date.

In one design the clockwork is designed so that upon actuating the actuating element five times, the clockwork changes into a sixth operating state and the hand is moved so that the hand position displays year information in the sixth operating state. The year information relates to the current date. The designs that were described allow simple and exact reading of date information without a special display element being required for this purpose. The explanations above for actuating twice apply correspondingly for the presence of a multiple actuation of the actuation element. The same applies for the always possible automatic change from the third, fourth, fifth or respectively sixth operating state back into the first operating state which can be designed as in conjunction with the change from the second operating state into the first operating state.

In one design the clockwork is designed so that during a change of the operating state which originates from the first operating state, the hand always moves in the clockwise direction and upon a change of the operating state which returns into the first operating state, the hand always moves counterclockwise, or vice versa. A change which originates from the first operating state can be in particular a change from the first operating state into the second operating state, but also a change from the first operating state into the third, fourth, fifth or sixth operating state, such as results upon multiple actuation of the actuating element. A change which returns into the first operating state can in particular be a change from the second operating state into the first operating state, but also a change from the third, fourth, fifth or sixth operating state back into the first operating state. "Or vice versa" means that the hand with a change originating from the first operating state is moved counterclockwise, and with a change returning into the first operating state is moved clockwise. The different direction of rotation facilitates reading the timepiece, because with awareness of a specific direction of rotation it is immediately apparent whether the subsequent hand representation corresponds to one of the further operating states, thus for example the hour information can be read, or whether already the change back to the minute display has already occurred.

BRIEF DESCRIPTION OF THE DRAWINGS

The invention is explained in greater detail below based on an exemplary embodiment shown in six figures. The figures show.

DETAILED DESCRIPTION OF THE INVENTION

Figure 1:
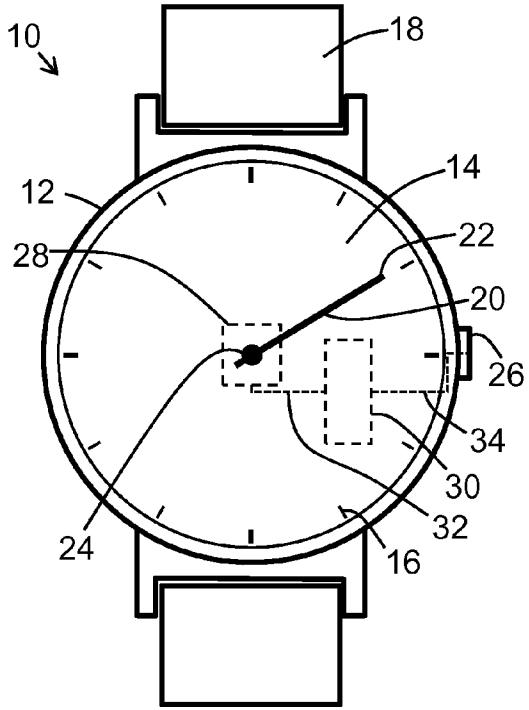
FIG. 1 a single hand timepiece according to the invention in the first operating state in a schematic representation, FIG. 2 the single hand timepiece from FIG. 1 in a second operating state, FIG. 3 the single hand timepiece from FIG. 1 in a third operating state, FIG. 4 the single hand timepiece from FIG. 1 in a fourth operating state, FIG. 5 the single hand timepiece from FIG. 1 in a fifth operating state, and FIG. 6 the single hand timepiece from FIG. 1 in a sixth operating state.

The single hand timepiece 10 from FIG. 1 has a case 12 and a face 14. The face 14 has a scale with twelve scale markings in the form of graduation marks 16 which are arranged at the positions that an hour hand of a conventional timepiece takes on for the respective full hour. In addition, the single hand timepiece 10 has a wrist band 18 that is fastened to the case 12.

The single hand timepiece 10 has a single hand 20 with a tip of the hand 22. The hand 20 is mounted in a rotatable manner about an axis of rotation 24 so that the tip of the hand 22 revolves on a circular path. An actuating element 26 in the form of a pushbutton is located on the right side of the case 12.

Elements arranged inside the single hand timepiece 10 are drawn with dashed lines. This is a clockwork that has a stepping motor 28 which forms an adjustment drive for the hand 20, with which the hand 20 can be moved between a plurality of different hand positions. The clockwork further has an electronic control 30 which controls the stepping motor 28. The electronic control 30 is connected to the stepping motor 28 via a first electrical conductor 32. It is connected to an actuating element 26 via a second electrical conductor 34.

All different operating states of the single hand timepiece 10 are explained for the time of day 08:10:51 and the date May 30, 2013 as an example. FIG. 1 shows the first operating state that can also be called the basic state. In this first operating state the hand 20 displays minute information. The hand 20 is in a hand position which corresponds to a minute hand of a conventional timepiece of the 10 minute position. Thereby, the minute information "10" is represented.

Figure 2:
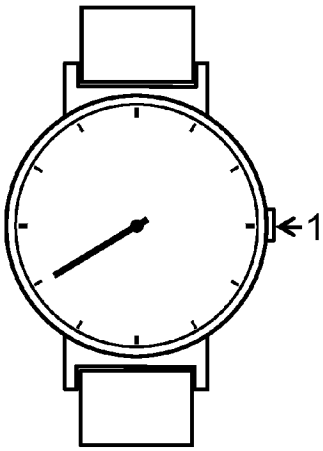

If starting from the first operating state of FIG. 1, the actuating element 26 is actuated once, the clockwork, or respectively the control 30, changes into the second operating state which is represented in FIG. 2. In the second operating state the clockwork positions the hand 20 into a hand position which corresponds to the forty minute position of a minute hand of a conventional timepiece. Thereby the hour information "eight" is represented. If in the second operating state there is no further actuating of the actuating element 26, the clockwork automatically changes back into the into the first operating state shown in the FIG. 1, and as a consequence represents the minute information.

Figure 3:
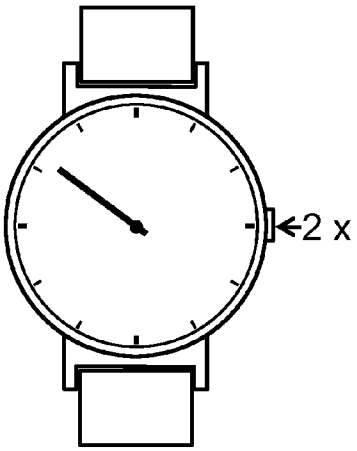

If however there is a second actuation of the actuating element 26, the control 30 changes into the third operating state shown in FIG. 3. In this third operating state, the hand 20 is moved into a hand position which corresponds to the 51 minute position of a minute hand of a conventional timepiece. Because the single hand timepiece 10 is located in the third operating state in which the second information is represented, this means that the current second information is "51".

Figure 4:
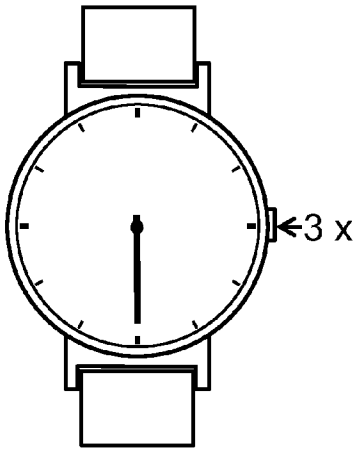

In the event of a third actuation of the actuating element 26, the fourth operating state results, which is represented in FIG. 4. The hand 20 is moved into the minute position which corresponds to a representation of the day "30".

Figure 5:
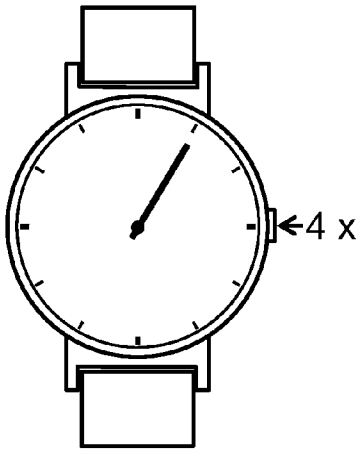

In the event of a fourth actuation of the actuating element 26, the clockwork changes into the fifth operating state represented in FIG. 5 in which the hand 20 takes on the "5 minute position". This corresponds to the calendar month of May.

Figure 6:
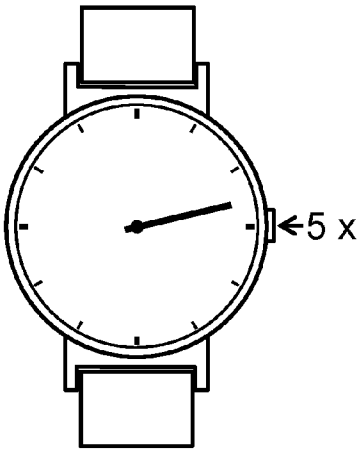

In the event of a fifth actuation of the actuating element 26, the clockwork changes into the sixth operating state which is represented in FIG. 6. The hand 20 is moved into the "13 minute position", which corresponds to a representation of the year number "13".

The invention claimed is:

1. A single hand timepiece comprising a single hand, which is movable into a plurality of hand positions, a clockwork for mechanically moving the hand so that the hand is located in a hand position which corresponds to a current time of day, wherein the single hand timepiece has an actuating element connected to the clockwork, and the clockwork is designed to change, upon actuation of the actuating element, from a first operating state into a second operating state and to control the hand so that the hand position in the first operating state displays minute information and in the second operating state displays hour information.

2. The single hand timepiece according to claim 1, wherein the timepiece is designed so that exactly 60 unique distinguishable hand positions are possible.

3. The single hand timepiece according to claim 1, wherein the clockwork is designed so that in the second operating state exactly twelve unique distinguishable hand positions are possible.

4. The single hand timepiece according to claim 1, wherein the clockwork has an electromechanical control element for moving the hand.

5. The single hand timepiece of claim 1, wherein the clockwork is an electronic clockwork.

6. The single hand timepiece of claim 1, wherein the single hand timepiece has a wrist band.

7. The single hand timepiece of claim 1, wherein the clockwork is designed to change back automatically, after actuation of the actuating element, into the first operating state.

8. The single hand timepiece of claim 1, wherein the clockwork is designed to remain, after actuation of the actuating element, in the second operating state for a predefined period.

9. The single hand timepiece of claim 1, wherein the clockwork is designed to change, upon actuating the actuating element twice, into a third operating state, and to move the hand such that the hand position in the third operating state displays second information.

10. The single hand timepiece of claim 1, wherein the clockwork is designed to change, upon actuating the actuating element three times, into a fourth operating state, and to move the hand such that the hand position in the fourth operating state displays day information.

11. The single hand timepiece of claim 1, wherein the clockwork is designed to change, upon actuating the actuating element four times, into a fifth operating state and to move the hand such that the hand position in the fifth operating state displays month information.

12. The single hand timepiece of claim 1, wherein the clockwork is designed to change, upon actuating the actuating element five times, into a sixth operating state, and to move the hand such that the hand position in the sixth operating state displays year information.

13. The single hand timepiece of claim 1, wherein the timepiece is designed so that the hand, upon a change of the operating state which originates from the first operating state, always moves clockwise, and upon a change of the operating state which returns into the first operating state, always moves counterclockwise, or vice versa.

* * * * *